US005418327A

United States Patent [19]

Lace, Sr. et al.

[11] Patent Number: 5,418,327

[45] Date of Patent: May 23, 1995

[54] MOUNTING ASSEMBLY

[75] Inventors: Donald A. Lace, Sr.; Dorothy Lace, both of Huntington Beach, Calif.

[73] Assignee: Actodyne General, Inc., Huntington Beach, Calif.

[21] Appl. No.: 388

[22] Filed: Jan. 4, 1993

[51] Int. Cl.[6] ..... G10H 3/00; G10H 1/32

[52] U.S. Cl. ..... 84/743

[58] Field of Search ..... 84/723, 725, 726, 743

[56] References Cited

U.S. PATENT DOCUMENTS

| | | | |
|---|---|---|---|
| Re. 32,520 | 10/1987 | Lace . | |
| 2,089,171 | 8/1937 | Beauchamp . | |
| 2,119,584 | 7/1938 | Knoblaugh . | |
| 2,175,325 | 10/1939 | Sunshine . | |
| 2,209,016 | 7/1940 | Dickerson . | |
| 2,294,861 | 9/1942 | Fuller . | |
| 2,445,046 | 7/1948 | Tinkham . | |
| 2,557,754 | 6/1951 | Morrison . | |
| 2,567,570 | 9/1951 | McCarty . | |
| 2,573,254 | 10/1951 | Fender . | |
| 2,612,541 | 9/1952 | DeArmond . | |
| 2,683,388 | 7/1954 | Keller . | |
| 2,725,778 | 12/1955 | Cronwell . | |
| 2,764,052 | 9/1956 | McBride . | |
| 2,817,261 | 12/1957 | Fender . | |
| 2,892,371 | 6/1959 | Butts . | |
| 2,896,491 | 7/1959 | Lover . | |
| 2,909,092 | 10/1959 | DeArmond et al. . | |
| 2,911,871 | 11/1959 | Schultz . | |
| 2,968,204 | 1/1961 | Fender . | |
| 2,976,755 | 3/1961 | Fender . | |
| 3,066,567 | 12/1962 | Kelley, Jr. . | |
| 3,183,296 | 5/1965 | Miessner . | |
| 3,236,930 | 2/1966 | Fender . | |
| 3,249,677 | 5/1966 | Burns et al. . | |
| 3,290,424 | 12/1966 | Fender . | |
| 3,417,268 | 12/1968 | Lace . | |
| 3,483,303 | 12/1969 | Warner . | |
| 3,530,228 | 9/1970 | Scherer . | |
| 3,535,968 | 10/1970 | Rickard . | |
| 3,541,219 | 11/1970 | Abair . | |
| 3,571,483 | 3/1971 | Davidson . | |
| 3,588,311 | 6/1971 | Zoller . | |
| 3,602,627 | 8/1971 | McCammon . | |
| 3,657,461 | 4/1972 | Freeman . | |
| 3,668,295 | 6/1972 | Broussard . | |
| 3,711,619 | 1/1973 | Jones . | |
| 3,715,446 | 2/1973 | Kosinski . | |
| 3,725,561 | 4/1973 | Paul . | |
| 3,902,394 | 9/1975 | Stich . | |
| 3,911,777 | 10/1975 | Rendell . | |
| 3,916,751 | 11/1975 | Stich . | |
| 3,962,946 | 6/1976 | Rickard . | |
| 3,983,777 | 10/1976 | Bartolini . | |
| 3,983,778 | 10/1976 | Bartolini . | |
| 3,992,972 | 11/1976 | Rickard . | |
| 4,026,178 | 5/1977 | Fuller . | |
| 4,056,255 | 11/1977 | Lace . | |
| 4,133,243 | 1/1979 | DiMarzio . | |
| 4,254,683 | 3/1981 | Nulman . | |
| 4,268,771 | 5/1981 | Lace . | |
| 4,269,103 | 5/1981 | Underwood . | |
| 4,283,982 | 8/1981 | Armstrong . | |
| 4,320,681 | 3/1982 | Altilio . | |
| 4,372,186 | 2/1983 | Aaroe . | |
| 4,379,421 | 4/1983 | Nunan . | |
| 4,624,417 | 11/1986 | McDougall . | |
| 4,809,578 | 3/1989 | Lace . | |
| 4,854,210 | 8/1989 | Palazzolo . | |
| 4,872,386 | 10/1989 | Betticare | 84/726 |
| 5,031,501 | 7/1991 | Ashworth | 84/723 |

*Primary Examiner*—William M. Shoop, Jr.
*Assistant Examiner*—Jeffrey W. Donels
*Attorney, Agent, or Firm*—Bliss McGlynn

[57] ABSTRACT

A mounting assembly for a pick-up of a stringed musical instrument includes at least one mounting stud connected to a case of a pick-up and a disc disposed about the mounting stud for dampening vibrations. The mounting assembly also includes a mounting bracket structure disposed adjacent the disc and operatively connected to the mounting stud for attaching the pick-up to a stringed musical instrument.

16 Claims, 2 Drawing Sheets

MOUNTING ASSEMBLY

BACKGROUND OF THE INVENTION

1. Field of the Invention

The present invention relates generally to musical instruments and, more particularly, to a mounting assembly for a pick-up on a stringed musical instrument.

2. Description of the Related Art

Generally, stringed musical instruments such as an electric guitar have electromagnetic sensors or pick-ups for sensing mechanical vibrations of the strings and converting such into electrical signals. The electrical signals from the electromagnetic sensors or pick-ups are amplified and modified and, ultimately, reconverted into acoustical energy to produce music and the like.

An example of such an electromagnetic sensor or pick-up is disclosed in U.S. Pat. No. 4,809,578, issued Mar. 7, 1989, entitled "Magnetic Field Shaping In An Acoustic Pick-up Assembly" the disclosure of which is hereby incorporated by reference. This patented pick-up assembly includes an elongated ferromagnetic case lined on the interior thereof with planar permanent magnet pieces to present the same magnetic polarity into the interior thereof. The patented pick-up assembly also includes cores disposed in the interior of the case and having a plurality of coplanar, spaced, finger-like projections directed at the walls of the case. The walls and projections are permanently magnetized to a common magnetic polarity which will concentrate by magnetic repulsion flux into gaps between the projections. A coil is wound around the cores and the flux changes of these concentrated flux fields due to string motion induce a voltage in the coil. The coil has terminals connected to a socket in the stringed musical instrument for connection to an amplifier and speaker system.

Conventionally, various mounting systems have been provided for pick-ups. However, these mounting systems suffer from the disadvantage that vibrations through the mounting system may interfere with the sensing of the mechanical vibrations of the strings by the pick-up. Consequently, there is a need in the art to provide a mounting assembly which can acoustically isolate the pick-up from its mounting structure.

Additionally, conventional mounting systems suffer from the disadvantage of "microphonics" when the pick-up is mounted on a stringed musical instrument such as a guitar. When the strings are plucked, the vibratory motion of the strings reverberates throughout the body of the guitar. As a result, the coil of the pick-up may be mechanically shaken or vibrated so that some of the coil windings move with respect to each other. Such movement will cross some of the magnetic flux lines and induce an electro-motive force (EMF) or electrical signal into the pick-up which is different than that which is induced therein by the movement of the strings. Such mechanically-induced electrical signals fall into the broad category of what is termed "microphonics". Microphonics are highly undesirable in such a situation because it is not part of the "sound" produced by the plucking of the strings by the musician, and is considered, for the most part, as "noise".

Consequently, musicians which play stringed musical instruments are ever desirous of having pick-ups which incorporate greater sensitivity to the full range of acoustic energy generated by the movement of such strings. Such greater sensitivity often requires a balancing of the overall sensitivity of the pick-up and the attenuation of extraneous noise, whether electrically or by mechanical vibrations. Thus, there is a need in the art to provide a mounting system which virtually eliminates microphonics and the other adverse effects of mechanical and/or acoustic vibrations and allows the use of an acoustic pick-up with greater sensitivity.

SUMMARY OF THE INVENTION

It is, therefore, one object of the present invention to provide a mounting assembly for a pick-up on a musical instrument.

It is another object of the present invention to provide a mounting assembly for a pick-up on a stringed musical instrument.

It is yet another object of the present invention to provide a mounting assembly for a pick-up which mechanically isolates the pick-up from the stringed musical instrument upon which it is mounted.

It is still another object of the present invention is to provide a mounting assembly for a pick-up which substantially isolates the pick-up from the introduction of microphonics.

It is a further object of the present invention to provide a mounting system for a pick-up which continually drains accumulations of static electrical charges from the pick-up.

To achieve the foregoing objects, the present invention is a mounting assembly for a pick-up of a stringed musical instrument including at least one mounting stud connected to a case of a pick-up and a disc means disposed about the mounting stud for dampening vibrations. The mounting assembly also includes a mounting bracket means disposed adjacent the disc means and operatively connected to the mounting stud for attaching the pick-up to a stringed musical instrument.

One advantage of the present invention is that a mounting assembly is provided for mounting a pick-up on a stringed musical instrument. Another advantage of the present invention is that the mounting assembly incorporates elastomeric members to mechanically isolate the pick-up from the stringed musical instrument upon which it is mounted. Yet another advantage of the present invention is that the elastomeric members of the mounting assembly substantially isolate the pick-up from the effect of microphonics. A further advantage of the present invention is that the mounting assembly provides a positive electrical shield and electrical grounding system to continually drain away accumulations of static electrical charges which are prevented from being discharged into the pick-up, thereby eliminating extraneous and unwanted sounds.

Other objects, features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
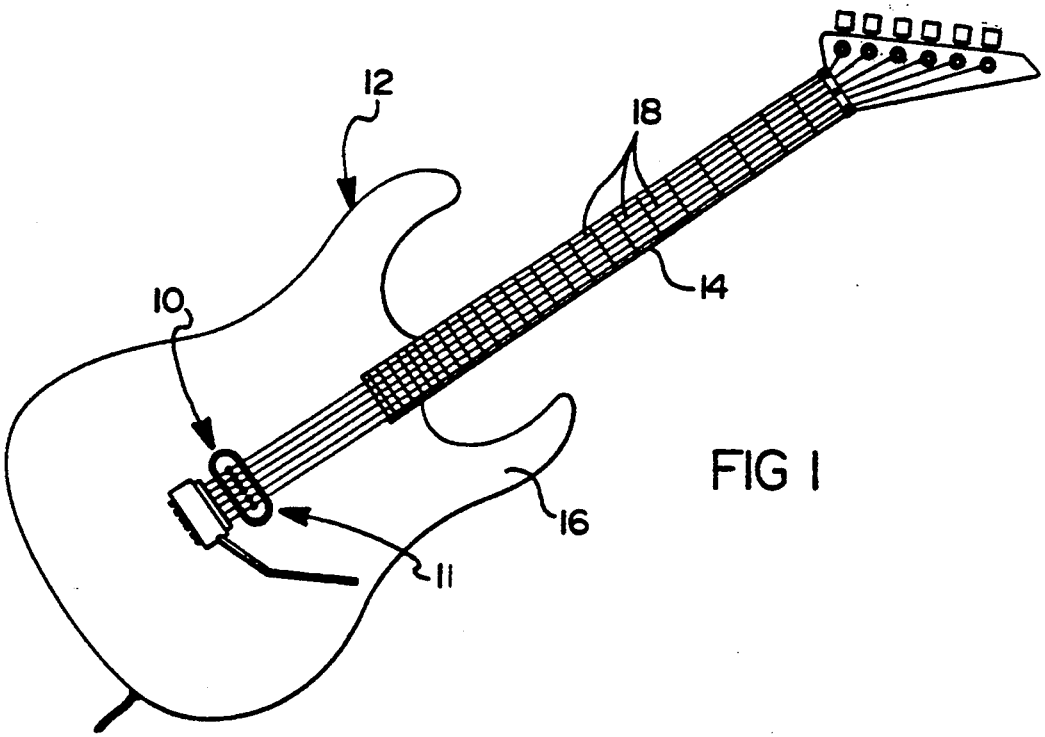
FIG. 1 is perspective view of a mounting assembly, according to the present invention, illustrated in operational relationship with a pick-up and a stringed musical instrument.

Referring to the drawings and in particular to FIG. 1, a mounting assembly 10, according to the present invention, is illustrated in operational relationship with a pick-up or pick-up assembly, generally indicated at 11, and a stringed musical instrument such as a guitar, generally indicated at 12. The guitar 12 is of the electric type and has a neck portion 14, a body portion 16, and a plurality of strings 18 extending along the neck and body portions 14 and 16. The mounting assembly 10 is disposed beneath the strings 18 and mounts the pick-up assembly 11 to the body portion 16. The mounting assembly 10 mechanically, microphonically, and electrostatically isolates the pick-up assembly 11 from the guitar 12.

Figure 2:
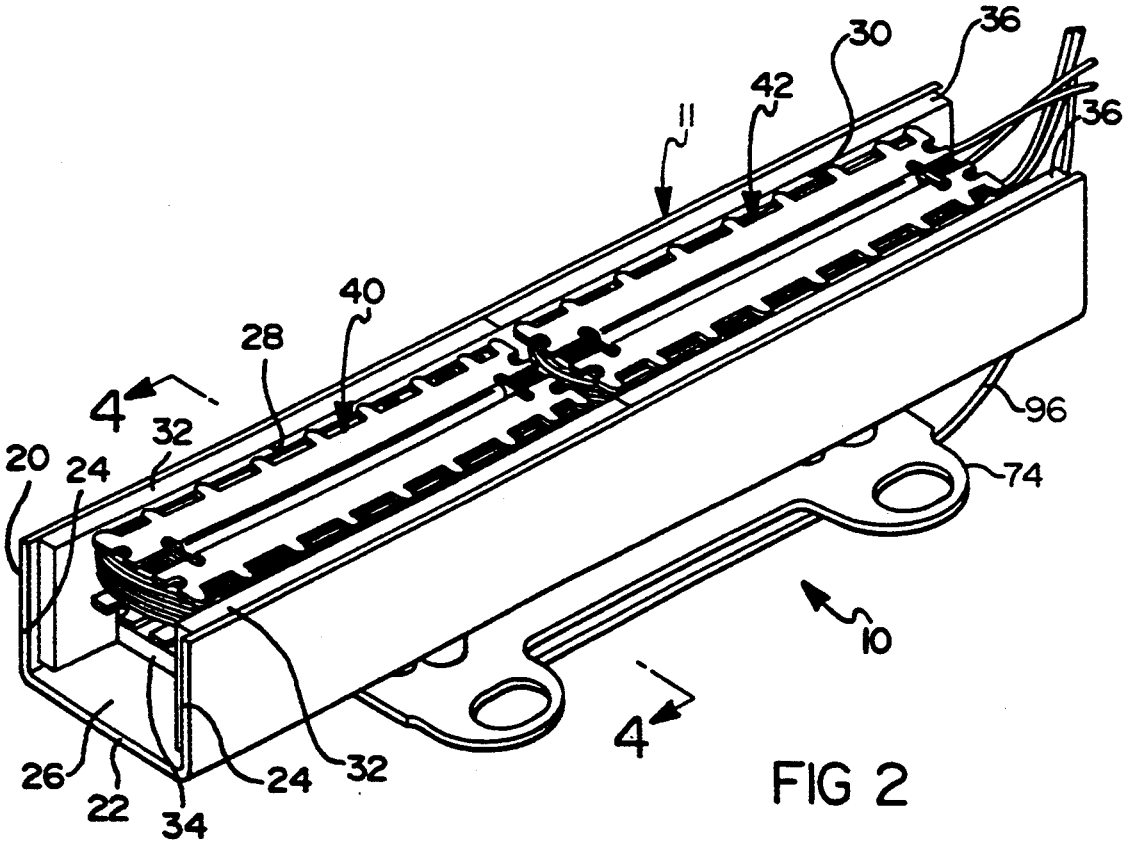
FIG. 2 is an enlarged perspective view of the mounting assembly and pick-up of FIG. 1.
Figure 3:
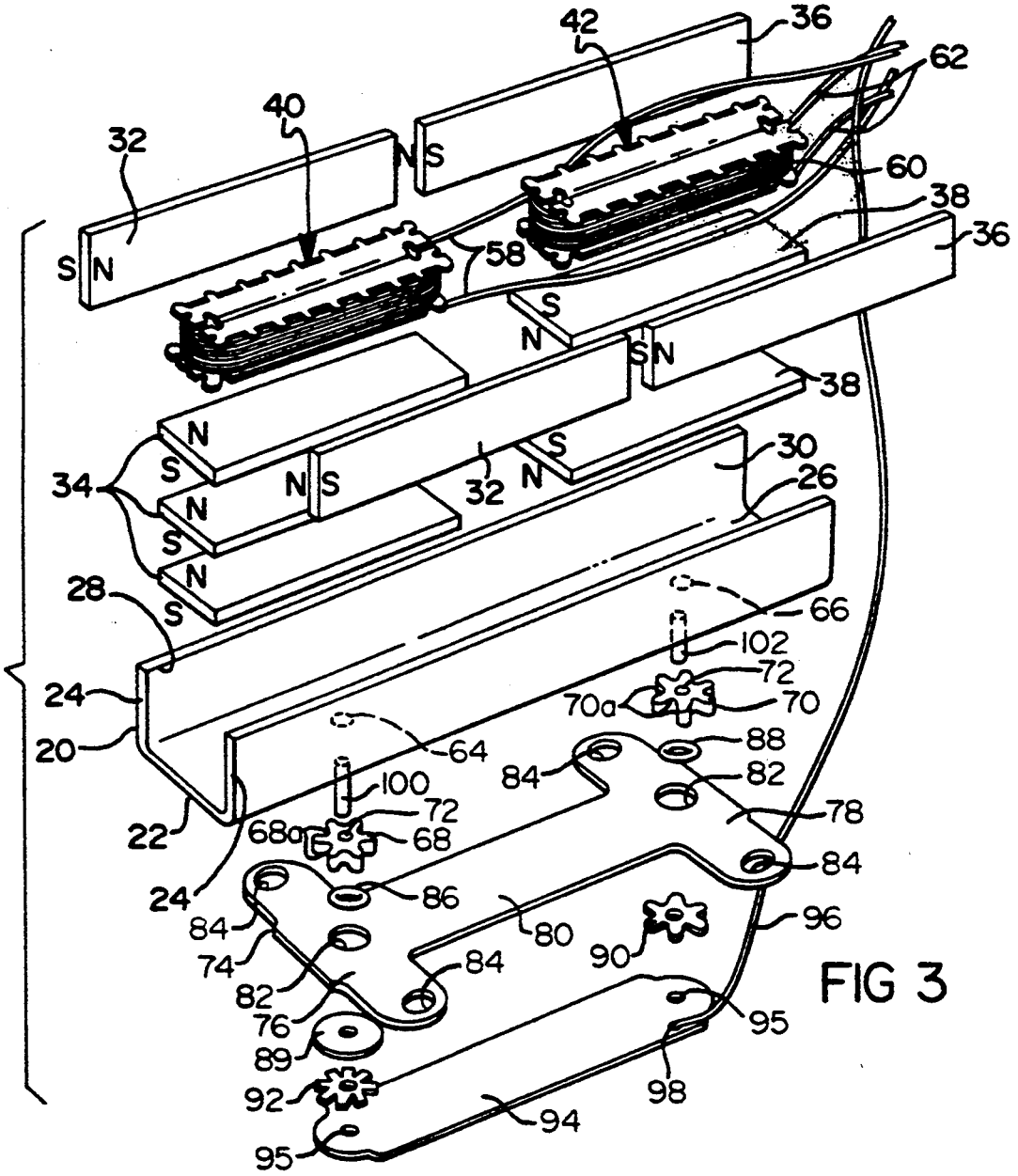
FIG. 3 is an exploded perspective view of the mounting assembly and pick-up of FIGS. 1 and 2.
Figure 4:
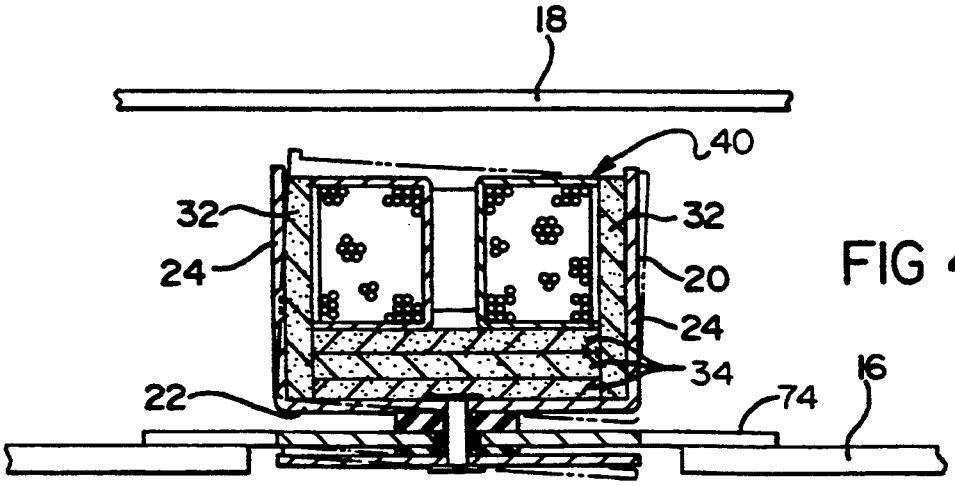
FIG. 4 is a sectional view taken along lines 4—4 of FIG. 2.

Referring to FIGS. 2 through 4, the pick-up assembly 11 is of a dual coil type described in a related application, entitled "DUAL COIL PICK-UP ASSEMBLY", filed on the same day as the present application, the disclosure of which is hereby incorporated by reference. The pick-up assembly 11 includes a case 20 extending longitudinally and having a general "U" shape. The case 20 has a generally planar base wall 22 and a pair of side walls 24 generally planar and parallel to each other and perpendicular to the base wall 22 to form a longitudinal channel 26. The case 20 is made of a ferromagnetic material such as an iron based steel. The case 20 is divided into a first section 28 which has a first common magnetic polarity and a second section 30 which has a second common magnetic polarity opposite to that of the first section 28.

The first section 28 includes at least one permanent magnet strip 32 and 34 disposed in the channel 26 and adhesively mounted to interior surfaces of the side and base walls 24 and 22, respectively, of the case 20 by suitable means such as an adhesive bonding agent. The permanent magnet strips 32 and 34 are arranged to present their north (N) magnetic polarity facing toward the interior of the channel 26 and their south (S) magnetic polarity impressed on the case 20.

The second section 30 also includes at least one permanent magnet strip 36 and 38 disposed in the channel 26 and adhesively mounted to interior surfaces of the side and base walls 24 and 22, respectively, of the case 20 by suitable means such as an adhesive bonding agent. The permanent magnet strips 36 and 38 are arranged to present their south (S) magnetic polarity facing toward the interior of the channel 26 and their north (N) magnetic polarity impressed on the case 20.

The pick-up assembly 10 further includes a first coil assembly, generally indicated at 40, disposed in the first section 28 and a second coil assembly, generally indicated at 42, disposed in the second section 30. The first coil assembly 40 includes a conductor such as copper wire wrapped or wound around core pieces in a first direction to form a first pick-up coil 56. The first pick-up coil 56 has a pair of leads 58 extending outwardly from one end of the channel 26. The second coil assembly 42 includes a conductor such as copper wire wrapped or wound around core pieces in a second direction opposite to the first direction to form a second pick-up coil 60. The second pick-up coil 60 has a pair of leads 62 connected in series to the first leads 58 and to a socket (not shown) on the guitar 12 for connection to an amplifier and speaker system (not shown).

Referring to FIGS. 3 and 4, the mounting assembly 10 includes first and second apertures 64 and 66 spaced longitudinally and extending through the base wall 22 of the case 20. The mounting assembly 10 also includes a first disc 68 and a second disc 70 disposed adjacent the base wall 22. The first and second discs 68 and 70 are generally star shaped and have a central aperture 72 extending therethrough. The first and second discs 68 and 70 are formed of an electrically non-conductive elastomeric material which is deformable and/or compressible for acoustic and/or mechanical vibration and electrical isolation between the case 20 and other portions of the mounting assembly 10. The first and second discs 68 and 70 are each cut in radial fashion about one-quarter ($\frac{1}{4}$) of the diameter of the discs. These radial cuts, typically six in number, identified as 68*a* and 70*a*, act to reduce the resistance to mechanical compression at the peripheral portion of each of the discs 68, 70 as compared to the solid annular portion of the discs 68, 70 which are uncut.

The mounting assembly 10 further includes a mounting bracket 74 disposed adjacent the first and second discs 68 and 70. The mounting bracket 74 includes first and second leg portions 76 and 78 extending laterally and a base portion 80 extending longitudinally and interconnecting the first and second leg portions 76 and 78 to form a general "H" shape. Alternatively, the leg portions 76 and 78 may extend longitudinally from the base portion 80 to form a single longitudinal strip. It should be appreciated that the mounting bracket 74 may have other suitable shapes.

The leg portions 76 and 78 each have a central aperture 82 aligned with the apertures 64 and 66 of the case 20. The first and second leg portions 76 and 78 also include a mounting aperture 84 extending therethrough at each end. The mounting aperture 84 has an oblong diameter smaller than a diameter of the central aperture 82 to receive fasteners (not shown) which extend therethrough to secure the mounting bracket 74 to the body portion 16 of the guitar 12.

The mounting assembly 10 also includes first and second O-rings 86 and 88 disposed in the central apertures 82 of the mounting bracket 74. The O-rings 86 and 88 are made of an electrically non-conductive elastomeric material and act as a centering mechanism for a function to be described.

The mounting assembly 10 further includes a third disc 89 and a fourth disc 90 disposed adjacent the bracket 74. The third disc 89 is generally circular in shape and made of an electrically conductive material. The fourth disc 90 is formed of an electrically non-conductive elastomeric material and shaped similar to the first and second discs 68 and 70. The third and fourth discs 89 and 90 have a thickness less than a thickness of the first and second discs 68 and 70. The third disc 89 also includes a locking washer 92 intimately engaged therewith for providing positive contact between the plate 94, disc 89 and mounting bracket 74.

The mounting assembly 10 also includes an electrically-conductive, longitudinally extending plate 94 functioning as an electrical and static electricity ground. The plate 94 has a pair of apertures 95 spaced longitudinally and extending therethrough. The plate 94 also has an insulated ground wire 96 passed through an aperture 98 in the plate 94. The end of the ground wire 96 is stripped of its insulation and soldered directly to the plate 94 as illustrated in FIG. 3. It should be appreciated that the ground wire 96 is connected to a ground source (not shown).

The mounting assembly 10 further includes a first mounting stud 100 and a second mounting stud 102 to secure the discs 68, 70, 89, 90, plate 94 and mounting bracket 74 to the case 20. The mounting studs 100 and 102 are formed of non-magnetic metal material such as brass. The first and second mounting studs 100 and 102 are, preferably, press-fitted into the pair of apertures 64 and 66, respectively, of the case 20. The mounting studs 100, 102 extend through discs 89, 90, plate 94, discs 68, 70, O-rings 84 and 86, and apertures 82, and both ends are radially deformed to secure the mounting studs 100, 102 and lock the mounting assembly 10 and pick-up assembly 11 together.

In operation, the first and second discs 68 and 70 effectuate a nearly uniform spring or dampening rate as the case 20 is moved or tilted with respect to the mounting bracket 74, as illustrated by phantom lines in FIG. 4, to maximize the vibration dampening and/or isolation characteristics of the discs 68, 70 with respect the mounting bracket 74. The uncut central portion of the discs 68, 70 largely maintains a relatively fixed spacing between the base wall 22 of the case 20 and the mounting bracket 74, while allowing relative movement, of the case 20 about its longitudinal axis, but not so much as to allow the case 20 to contact the mounting bracket 74.

Further, the O-rings 86, 88 are slightly stretched into mating engagement with the mounting studs 100, 102 to produce a snug fit about the mounting studs 100, 102. As the mounting studs 100, 102 are caused to move from side-to-side, as illustrated by the phantom lines in FIG. 4, the O-rings 86, 88 deform elastically and resist the electrically-conductive mounting studs 100, 102 from coming into electrical contact with the mounting bracket 74. Because of the elastic deformation of the O-rings 86, 88, the restorative force in the O-rings 86, 88 created by the vibration which causes the deformation to begin with, tends to force the mounting studs 100, 102 back into the studs original at-rest, pre-deformation position as illustrated by solid lines in FIG. 4.

Additionally, electrostatic shielding is provided by the third disc 89, washer 92 and plate 94 which greatly reduces the random "popping" noises due to accumulating electrostatic charges. The plate 94 has a ground wire 96 which is grounded for "draining" away such relatively large electrostatic voltage charges prior to reaching an avalanche" or break-down point which would result in a rapid discharge of the accumulated electrostatic charge and induce one or more "pops" in the pick-up assembly 11.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A mounting assembly for a pick-up of a stringed musical instrument comprising:

at least one mounting stud connected to a case of a pick-up;

at least one disc disposed about said at least one mounting stud for dampening vibrations;

a mounting bracket disposed adjacent said at least one disc and operatively connected to said at least one mounting stud for attaching the pick-up to a stringed musical instrument;

said mounting bracket having at least one aperture extending therethrough; and at least one O-ring disposed about said at least one mounting stud and in said at least one aperture to center said at least one mounting stud relative to said mounting bracket.

2. A mounting assembly as set forth in claim 1 wherein said disc is made of an elastomeric material.

3. A mounting assembly as set forth in claim 1 including means for draining electrostatic charges from said mounting assembly.

4. A mounting assembly as set forth in claim 3 wherein said means comprises a plate secured to said at least one mounting stud and a ground wire interconnecting said plate and a ground source.

5. A mounting assembly for a pick-up of a stringed musical instrument comprising:

at least one mounting stud connected to a case of a pick-up;

first disc means disposed about said at least one mounting stud for dampening vibrations;

mounting bracket means disposed adjacent said first disc means and operatively connected to said at least one mounting stud for attaching the pick-up to a stringed musical instrument;

a plate secured to said at least one mounting stud and a ground wire interconnecting said plate and a ground source for draining electrostatic charges from said mounting assembly; and second disc means disposed about said at least one mounting stud for dampening vibrations.

6. A mounting assembly as set forth in claim 5 wherein said second disc means comprises a second disc made of elastomeric material and disposed between said mounting bracket and said plate.

7. A mounting assembly for a pick-up of a stringed musical instrument comprising:

a plurality of mounting studs connected to a case of a pick-up;

first disc means disposed about said mounting studs for dampening vibrations;

a mounting bracket disposed adjacent said first disc means and operatively connected to said mounting studs for attaching the pick-up to a stringed musical instrument; and a plate secured to said mounting studs and a ground wire interconnecting said plate and a ground source for draining electrostatic charges from said mounting assembly.

8. A mounting assembly as set forth in claim 7 wherein said first disc means comprises a first disc made of an elastomeric material and disposed about each of said mounting studs between the case and said mounting bracket.

9. A mounting assembly for a pick-up of a stringed musical instrument comprising:

a plurality of mounting studs connected to a case of a pick-up;

first disc means disposed about said mounting studs for dampening vibrations;

a mounting bracket disposed adjacent said first disc means and operatively connected to said mounting studs for attaching the pick-up to a stringed musical instrument;

a plate secured to said mounting studs and a ground wire interconnecting said plate and a ground source for draining electrostatic charges from said mounting assembly; and second disc means disposed about said mounting studs between said plate and said mounting bracket.

10. A mounting assembly as set forth in claim 9 wherein said second disc means comprises a second disc made of an electrically non-conductive material disposed about one of said mounting studs and a third disc made of an electrically conductive material disposed about the other of said mounting studs.

11. A mounting assembly as set forth in claim 10 wherein said third disc includes a locking washer engaged therewith.

12. A mounting assembly for a pick-up of a stringed musical instrument comprising:

at least one mounting stud connected to a case of a pick-up;

at least one disc made of an elastomeric material disposed about said at least one mounting stud for dampening vibrations;

a mounting bracket disposed adjacent said at least one disc and operatively connected to said at least one mounting stud for attaching the pick-up to a stringed musical instrument; and wherein said at least one disc has a plurality of recesses extending inwardly from a periphery to form radially spaced projections.

13. A mounting assembly for a pick-up of a stringed musical instrument comprising:

a plurality of mounting studs connected to a case of a pick-up;

at least one first disc made of an elastomeric material and disposed about each of said mounting studs adjacent the case for dampening vibrations;

a mounting bracket disposed adjacent said at least one first disc and operatively connected to said mounting studs for attaching the pick-up to a stringed musical instrument; and wherein said at least one first disc has a plurality of recesses extending inwardly from a periphery to form radially spaced projections.

14. A mounting assembly for a pick-up of a stringed musical instrument comprising:

a pair of mounting studs connected to a case of a pick-up;

at least one first disc made of an elastomeric material and disposed about each of said mounting studs adjacent the case for dampening vibrations;

a mounting bracket disposed adjacent said at least one first disc and operatively connected to said mounting studs for attaching the pick-up to a stringed musical instrument; and wherein said mounting bracket has a pair of central apertures extending therethrough.

15. A mounting assembly for a pick-up of a stringed musical instrument comprising:

a pair of mounting studs connected to a case of a pick-up;

at least one first disc made of an elastomeric material and disposed about each of said mounting studs adjacent the case for dampening vibrations;

a mounting bracket disposed adjacent said at least one first disc and operatively connected to said mounting studs for attaching the pick-up to a stringed musical instrument;

said mounting bracket having a pair of central apertures extending therethrough; and at least one O-ring disposed about each of said mounting studs and in each of said central apertures to center said mounting studs relative to said mounting bracket.

16. A mounting assembly for a pick-up of a stringed musical instrument comprising:

mounting studs connected to a case of a pick-up;

first discs disposed about each of said mounting studs;

a mounting bracket disposed adjacent said first discs for attaching the pick-up to the stringed musical instrument;

said mounting bracket having central apertures extending therethrough to receive said mounting studs;

O-rings disposed about said mounting studs and in said central apertures to center said mounting stud relative to said mounting bracket;

a plate secured to said mounting studs and a ground wire interconnecting said plate and a ground source; and second discs disposed about said mounting studs between said mounting bracket and said plate.

* * * * *

UNITED STATES PATENT AND TRADEMARK OFFICE

CERTIFICATE OF CORRECTION

PATENT NO. : 5,418,327

DATED : May 23, 1995

INVENTOR(S) : Donald A. Lace, Sr.

It is certified that error appears in the above-indentified patent and that said Letters Patent is hereby corrected as shown below:

Title page, column 2, line 26, under "References Cited, U.S. Patent Documents", "4,624,417" should be --4,624,172--.

Column 5, line 43, "studs" should be --studs'--.
(Application page 12, line 26).

Signed and Sealed this

Thirty-first Day of October 1995

Bruce Lehman

*Attest:*

BRUCE LEHMAN

*Attesting Officer*

*Commissioner of Patents and Trademarks*